US008281488B2

(12) United States Patent
Wieres et al.

(10) Patent No.: US 8,281,488 B2
(45) Date of Patent: Oct. 9, 2012

(54) METHOD FOR PRODUCING A DIMENSIONALLY ACCURATE HONEYCOMB BODY

(75) Inventors: Ludwig Wieres, Overath (DE); Jörg Gutowski, Eisenach (DE); Hans-Günter Faust, Köln (DE); Ferdi Kurth, Mechernich (DE); Franz Föhres, Hennef (DE)

(73) Assignee: EMITEC Gesellschaft fuer Emissionstechnologie mbH, Lohmar (DE)

( * ) Notice: Subject to any disclaimer, the term of this patent is extended or adjusted under 35 U.S.C. 154(b) by 1100 days.

(21) Appl. No.: 11/645,830

(22) Filed: Dec. 26, 2006

(65) Prior Publication Data

US 2007/0143999 A1 Jun. 28, 2007

(30) Foreign Application Priority Data

Dec. 23, 2005 (DE) ..... 10 2005 061 778

(51) Int. Cl.
*B21D 51/16* (2006.01)

(52) U.S. Cl. ..... 29/890; 29/402.21; 29/458; 29/505; 29/515; 29/520; 29/525

(58) Field of Classification Search ..... 29/890, 29/890.08, 402.21, 458, 505, 509, 515, 520, 29/525, DIG. 13, DIG. 24
See application file for complete search history.

(56) References Cited

U.S. PATENT DOCUMENTS

| | | | | |
|---|---|---|---|---|
| 5,055,274 | A | 10/1991 | Abbott | |
| 5,909,916 | A * | 6/1999 | Foster et al. | 29/890 |
| 5,953,817 | A * | 9/1999 | Watanabe et al. | 29/890 |
| 6,066,228 | A * | 5/2000 | Brunson et al. | 156/294 |
| 6,551,535 | B2 * | 4/2003 | Sander | 264/39 |
| 6,824,744 | B1 | 11/2004 | Stoepler et al. | |
| 7,137,199 | B2 * | 11/2006 | Schug et al. | 29/890 |
| 7,174,634 | B2 * | 2/2007 | Morikawa et al. | 29/890 |
| 2006/0096093 | A1 | 5/2006 | Voit et al. | |
| 2007/0033803 | A1 * | 2/2007 | Lawrukovich et al. | 29/890 |

FOREIGN PATENT DOCUMENTS

| | | | |
|---|---|---|---|
| DE | 197 53 609 | A1 | 6/1999 |
| DE | 2005/001251 | A1 | 1/2005 |
| EP | 0 897 749 | A2 | 2/1999 |
| JP | 11197518 | A | 7/1999 |
| WO | 98/15354 | | 4/1998 |

* cited by examiner

*Primary Examiner* — Sarang Afzali
(74) *Attorney, Agent, or Firm* — Laurence A. Greenberg; Werner H. Stemer; Ralph E. Locher

(57) ABSTRACT

A method for producing a honeycomb body having a honeycomb structure disposed in a housing, includes at least forming a honeycomb structure, inserting the honeycomb structure into a housing, carrying out a heat treatment operation on the honeycomb structure having the housing, contacting outer regions with a molding, at least during the inserting step or the heat treatment step, and reproducing a desired outer contour of the housing with contact faces of the molding. A molding and an exhaust gas treatment unit produced with a thin housing in a dimensionally accurate manner, are also provided.

7 Claims, 2 Drawing Sheets

METHOD FOR PRODUCING A DIMENSIONALLY ACCURATE HONEYCOMB BODY

CROSS-REFERENCE TO RELATED APPLICATION

This application claims the priority, under 35 U.S.C. §119, of German Patent Application DE 10 2005 061 778.6, filed Dec. 23, 2005; the prior application is herewith incorporated by reference in its entirety.

BACKGROUND OF THE INVENTION

Field of the Invention

The present invention relates to a method for producing a honeycomb body having a honeycomb structure disposed in a housing. In addition, the present invention also relates to a tool or molding for producing a dimensionally accurate honeycomb body and an exhaust gas treatment unit having a honeycomb body. Such honeycomb bodies are used, in particular, for the aftertreatment of exhaust gases.

Honeycomb bodies of that type often include a metallic housing in which a ceramic or metallic honeycomb structure is disposed. There, part of the production process is to insert the honeycomb structure into the housing in a suitable way and ultimately to form a technical joining connection between the housing and the honeycomb structure. The preferred manner of producing the technical joining connection is by brazing. However, a sintering process or even welding may be used as well.

For that purpose, it is necessary for the contact between the honeycomb structure and the housing to be as uniform as possible. It should also be ensured that the honeycomb body is produced with a desired degree of circularity or dimensional accuracy. That is of interest in particular since it is ultimately intended to integrate the honeycomb body, for example, into the exhaust system of a mobile internal combustion engine, such as in a vehicle. There, the housing often serves as a contact face for further form-locking or force-locking connections. A form-locking connection is one which connects two elements together due to the shape of the elements themselves, as opposed to a force-locking connection, which locks the elements together by force external to the elements. Any inaccuracy in the outer shape results, under some circumstances, in sealing compounds for the retrospective compensation for dimensional tolerances, complex machine finishing or other time-consuming and expensive measures being necessary.

The problems regarding dimensional accuracy occur, in particular, in the case of honeycomb bodies which, for example, have a metallic honeycomb structure that is to be inserted in a non-cylindrical housing cross section. In that case, it can be that various forces or pressures from the honeycomb structure act on the housing in the peripheral direction of the housing. That alone can lead to slight deformation, specifically in the case of thin-walled housings. It has additionally been observed in the event of a non-uniform pressure distribution of that type that the effect is intensified during subsequent heat treatment operations on the honeycomb body. That can lead to further deformation of the housing and/or to a non-uniform connection of the honeycomb body to the housing.

SUMMARY OF THE INVENTION

It is accordingly an object of the invention to provide a method and a molding for producing a dimensionally accurate honeycomb body and an exhaust gas treatment unit having a honeycomb body, which at least partially overcome the hereinafore-mentioned disadvantages of the heretofore-known methods and devices of this general type.

With the foregoing and other objects in view there is provided, in accordance with the invention, a method for producing a honeycomb body having a honeycomb structure disposed in a housing. The method comprises at least:

a) forming a honeycomb structure;
b) inserting the honeycomb structure into a housing;
c) carrying out a heat treatment operation on the honeycomb structure having the housing;
d) contacting outer regions of the housing with a molding, at least during step b) or step c); and
e) reproducing a desired outer contour of the housing with contact faces of the molding.

Even though the method can fundamentally be used for any type of honeycomb structure, step a) preferably includes the formation of a metallic honeycomb structure. For this purpose, at least partially structured metal foils are layered and subsequently wound with one another. It is possible in this case for a spiral-shaped, S-shaped or other similarly constructed honeycomb structure to be produced. The honeycomb structure often includes a multiplicity of passages which are disposed substantially parallel to one another and through which an exhaust gas can flow. The honeycomb structure is conventionally prepared separately from the housing and is inserted into a housing in step b).

With regard to step b), the honeycomb structure is usually inserted into a housing (which is, in particular, closed in the peripheral direction) at the end side. For this purpose, it can be advantageous to provide a so-called insertion cone which is placed on the housing and through which the honeycomb structure is passed, with the honeycomb structure being reduced to the inner dimension of the housing by being slightly compressed.

Step c) relates, in particular, to a coating and/or a connecting method. With regard to the connecting method, it is preferable to use connecting methods in which sintered, brazed and/or welded connections are formed within the honeycomb structure or between the honeycomb structure and the housing.

The molding, form part or molding article has, in particular, the object of substantially maintaining a desired shape or configuration of the housing during the production process. With regard to the concrete embodiment of the molding, reference is made to the following explanations. At this point, however, it is pointed out that the molding, fitting part or structural part generally has a more stable construction than the housing and is in contact in regions in the peripheral direction of the housing. The contact faces are disposed, in particular, where an increased loading on the housing is expected as a result of the inserted honeycomb structure. This relates, in particular, to those regions which are at a relatively small distance from the central point of the honeycomb body and/or in regions of curved sections of the housing having a large radius of curvature. It is principally also possible to provide a plurality of moldings on a housing.

In accordance with another mode of the invention, the method is particularly advantageous when a honeycomb body having a non-circular housing cross section is produced. The term "non-circular" refers, in particular, to oval, "race track-like," angular or other cross sections which are not circular. These cross sections often have different radii of curvature, which can in some parts become infinite (straight housing section). It is specifically the case herein that the different stress states as described in the introduction hereto can occur during the heat treatment operation on the honeycomb body, so that it is possible, in particular, for honeycomb bodies of this type to be produced in a dimensionally accurate manner through the use of the method described herein.

In accordance with a further mode of the invention, it is therefore particularly advantageous for the molding to be placed in contact with the housing at the outside before step b), and removed again after step c). In other words, this means that the unit including the honeycomb structure and the housing is supported and held in a dimensionally accurate manner through the use of the molding until a technical joining connection is actually generated between component parts of the honeycomb structure and the housing.

In accordance with an added mode of the invention, it is advantageous for the molding to also be provided at least during one of the following machining processes on the housing:

providing brazing material to the honeycomb body, coating the honeycomb body, transporting the honeycomb body.

When brazing the honeycomb body, powdered brazing material is preferably supplied through an end side of the honeycomb body. It is additionally possible for the honeycomb body to be previously dipped into an adhesive liquid, which the brazing material is subsequently to remain adhered to in a defined manner. When coating the honeycomb body, a so-called washcoat coating is provided in particular. The washcoat coating is, for example, doped with noble metals and is subsequently calcined. With regard to transporting the honeycomb body, it is to be observed that the fixing of the honeycomb body through the use of the molding is maintained, for example when transporting between individual machining stations or to temporary storage.

With the objects of the invention in view, there is also provided a molding for producing a honeycomb body having a honeycomb structure disposed in a housing. The molding comprises a support body having a plurality of inwardly-directed contact faces for producing a desired outer contour of the housing by the method according to the invention.

The support body is preferably closed in the peripheral direction, for example in the manner of a frame. It is very particularly preferable for the support body to be formed in one piece. The inner contour of the support body accordingly has a plurality of inwardly-directed contact faces, that is to say that the contact faces encompass the furthest inward protruding partial region of the inner contour of the support body. The contact faces are directed or formed relative to one another in such a way that they substantially correspond to the desired outer contour of the housing. In other words, this means that the contact faces reproduce a part of the outer contour of the housing. It is, however, fundamentally possible for a part of the contact faces to also be beveled, so that it is made possible, for example, for the housing to be inserted into the support body more easily.

In accordance with another feature of the invention, it is principally also possible for the molding to be constructed in such a way that the relative position of the contact faces is adjustable with respect to one another. This makes it possible for the molding to be used particularly flexibly for different contours of the housing. There is also the advantage that moveable contact faces of this type make it easier for the housing or the honeycomb body to be removed, for example after carrying out a heat treatment operation.

In accordance with a further feature of the invention, it is also proposed that radially outwardly-directed recesses serve to space apart the inwardly-directed contact faces. The recesses preferably run substantially parallel to the contact faces and at least partially delimit the latter. Recesses of this type prevent the housing from exerting an excessively high contact pressure on the support body. The housing can therefore be more easily removed again after the machining operation.

In accordance with an added feature of the invention, it is therefore also particularly advantageous for the contact faces of the molding to cover between 50% and 80% of the periphery of the housing. This both ensures adequate fixing of the housing to provide dimensional stability, and also allows reliable removal of the housing even within the context of series production. In this case, the recesses can, for example, also be constructed to be suitable for gripping tools.

In accordance with an additional feature of the invention, it is particularly advantageous for the molding to be made from a high-temperature resistant and corrosion resistant metal. It is very particularly preferable for the molding to be made from an at least similar material to the housing, in order to ensure uniform thermal expansion behavior, in particular during a heat treatment operation on the honeycomb body. The metal should at least be capable of durably withstanding the thermal conditions during a brazing process.

In accordance with yet another feature of the invention, the contact faces are formed at least partially with a coating. Alternatively, or in combination with the latter, the contact faces can also be provided at least partially with a structured surface. These measures serve, for example, to avoid connections between the molding and the housing, as can occur, if appropriate, at high temperatures (for example sintered connections). The structured surface of the contact face also further reduces the area of contact between the molding and the housing, making it easier for the housing to be removed after the production process of the honeycomb body. Even if these measures can only be provided partially on the contact faces, their use is equally preferred for all of the contact faces.

With the objects of the invention in view, there is also provided an exhaust gas treatment unit, comprising a honeycomb body having a housing with a thickness of at most 1.5 mm, produced by the method or with the molding according to the invention.

Other features which are considered as characteristic for the invention are set forth in the appended claims, noting that the features listed individually in the claims can be combined with one another in any desired technologically meaningful way to reveal further embodiment variants of the invention.

Although the invention is illustrated and described herein as embodied in a method and a molding for producing a dimensionally accurate-honeycomb body and an exhaust gas treatment unit having a honeycomb body, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
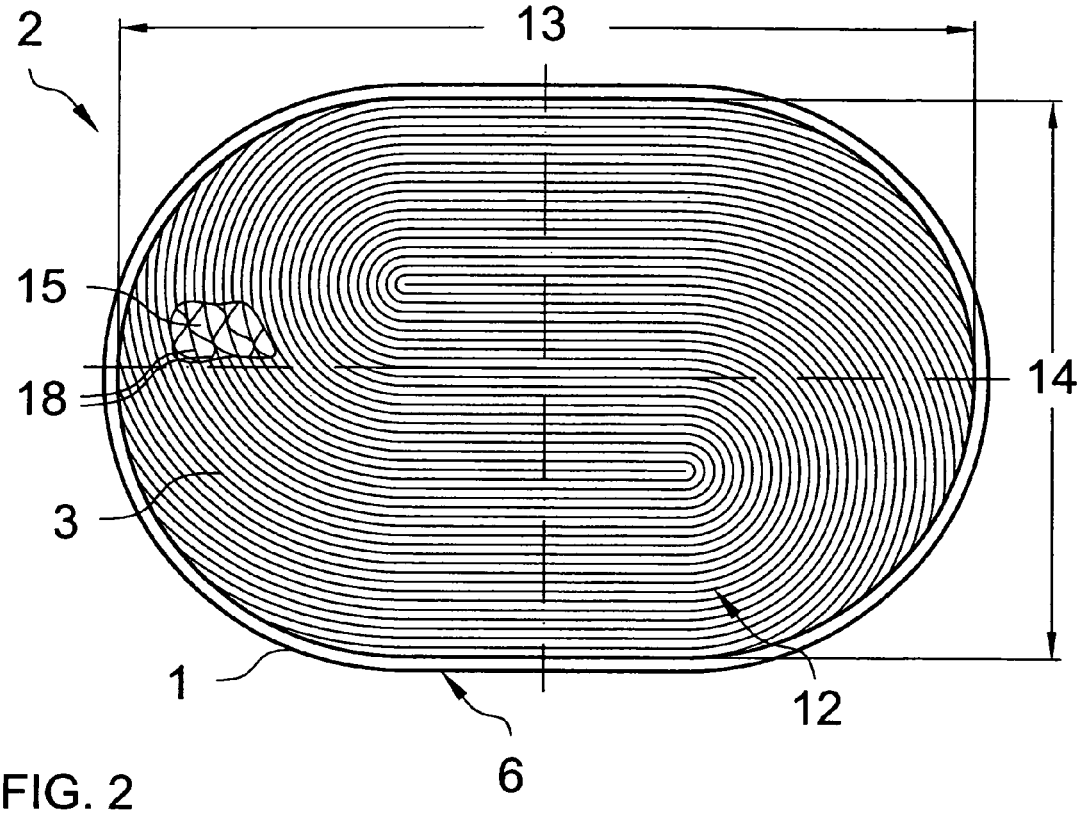
FIG. 1 is a diagrammatic, end-elevational view of a non-cylindrical honeycomb body.

Referring now to the figures of the drawings in detail and first, particularly, to FIG. 1 thereof, there is seen a diagrammatic end view of a honeycomb body 2 which has an internal honeycomb structure 3 and an outer housing 1. The housing 1 has a non-circular cross section 12 in which the honeycomb structure 3 is disposed. The cross section 12 is substantially oval, almost in the manner of a so-called "race track", having a first extent 13 and a second extent 14 which are different from one another. The illustration shows that the honeycomb body 2 is formed with a larger radius of curvature at the top and the bottom than at the left and the right.

The honeycomb structure 3 is constructed from a plurality of smooth metal foils 18 which are structured in a wound manner in an S-shape and form passages 15 which run substantially parallel to one another. In this configuration, in particular, different stresses from the metal foils 18 act on the housing 1. These stresses could influence an outer contour 6 of the housing 1, under some circumstances. In order to avoid deviations from the outer contour 6, it is proposed to use a molding, form part or molding article which is illustrated in FIG. 2 in a preferred embodiment variant, for a honeycomb body of this type.

Figure 2:
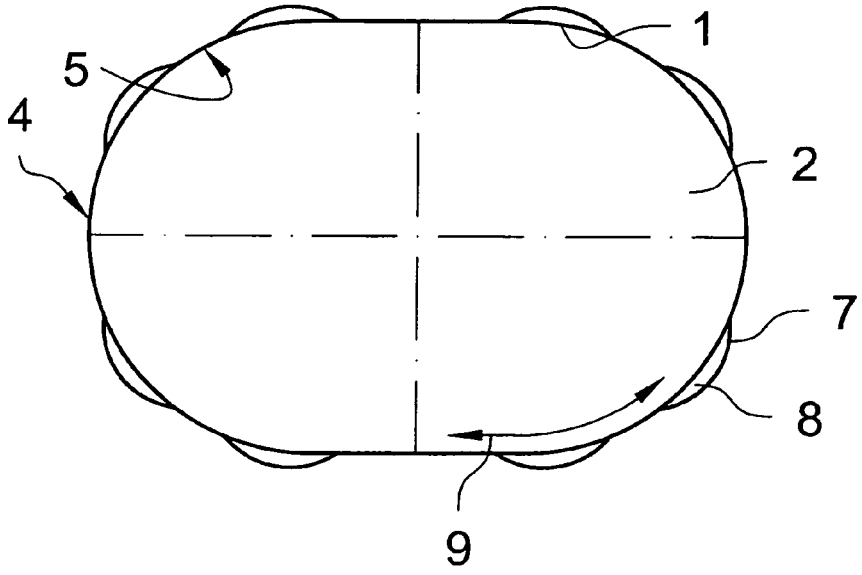
FIG. 2 is an end-elevational view of an embodiment variant of a molding.

A preferred embodiment variant of a molding or structural part 4 for the honeycomb body 2 illustrated in FIG. 1, is illustrated in FIG. 2. The molding 4 has a plurality of inwardly-directed contact faces 5 which are in contact with the diagrammatically-illustrated outer contour of the housing 1. It is also shown herein that the contact faces 5 cover more than half of a periphery 9 of the housing 1. A support body 7, which is disposed between the contact faces 5, is constructed in the manner of a border and has radially outwardly-directed recesses 8. There is no contact between the support body 7 and the housing 1 in these regions.

Figure 3:
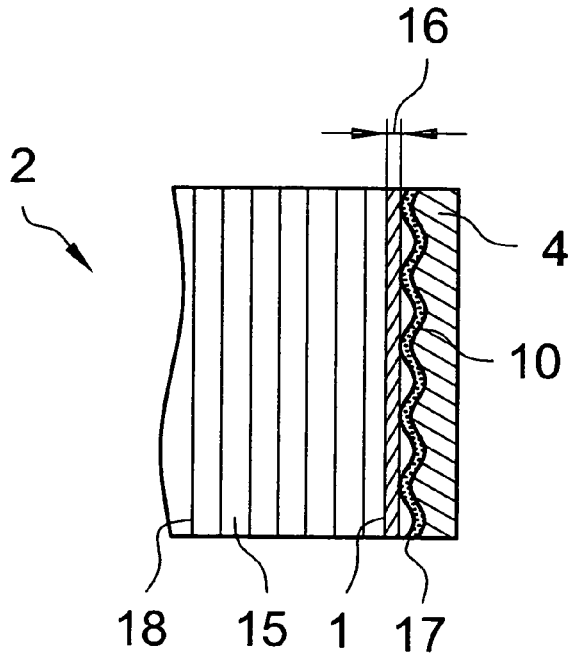
FIG. 3 is a fragmentary, partly-sectional view of a honeycomb body disposed in a molding.

FIG. 3 shows a fragmentary, cross-sectional view of a configuration of a honeycomb body 2 in the interior of a molding 4, corresponding to a further embodiment variant. Accordingly, a part of the honeycomb body 2 which is illustrated at the left-hand side of FIG. 3 is in turn formed with a plurality of metal foils 18, so that passages 15 which run substantially parallel to one another are formed. The metal foils 18 bear against the inside of the housing 1. The housing 1 has a thickness 16, for example in a range of up to 1.5 mm, advantageously even less than 1 mm or even 0.8 mm. The molding 4 bears against the outside of the housing 1 and the contact face 5, in this case, is formed with a coating 17 and a structured surface 10. The provision of the structured surface 10 ensures that the honeycomb body 2 can be easily removed from the molding 4, while the coating 17 prevents the formation of sintered connections between the molding 4 and the housing 1.

Figure 4:
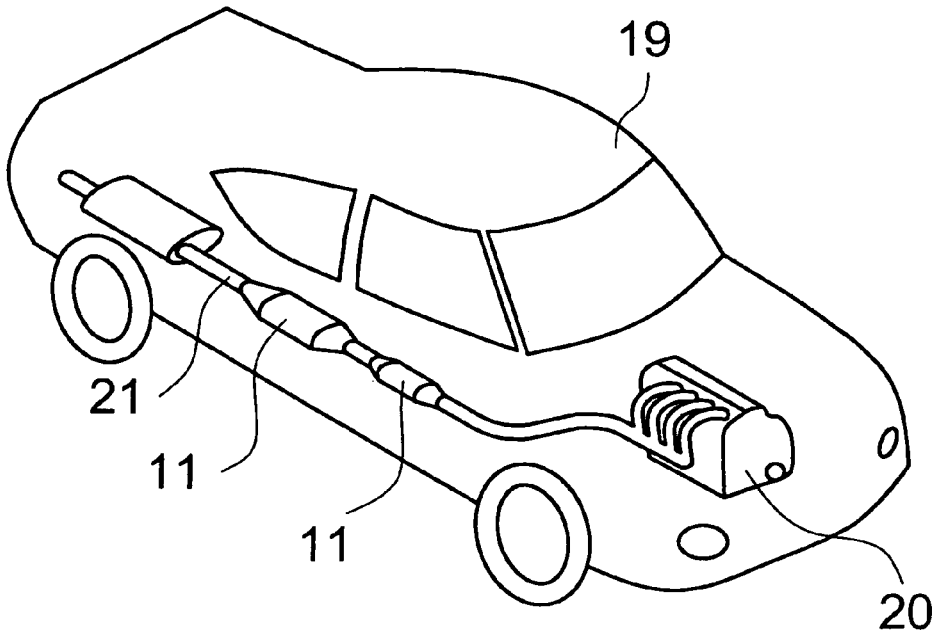
FIG. 4 is a perspective view of an exhaust system in a vehicle.

The preferred field of application for honeycomb bodies of this type is the automotive field. Accordingly, FIG. 4 diagrammatically illustrates the configuration of an exhaust system 21 for a vehicle 19. Exhaust gas generated by an engine 20 is conducted through a plurality of exhaust gas treatment units 11 until it has been freed from pollutants to such a degree that it can be discharged to the atmosphere. The exhaust gas treatment unit 11 is, in particular, equipped with the honeycomb body described herein. The invention makes it possible, in particular, for exhaust gas treatment units to be produced with thin housings in a dimensionally accurate manner.

We claim:

1. A method for producing a honeycomb body having a honeycomb structure disposed in housing, the method comprising the following steps:

a) forming a honeycomb structure;

b) inserting the honeycomb structure into a housing;

c) coating the honeycomb body and/or forming sintered, brazed and/or welded connections within the honeycomb structure by carrying out a heat treatment operation on the honeycomb structure having the housing;

d) contacting outer regions of the housing with a single molding, at least during steps b) and c); and e) ensuring dimensional accuracy of the honeycomb body by reproducing a desired outer contour of the housing with contact faces of the molding.

2. The method according to claim 1, which further comprises producing a non-circular cross section of the housing of the honeycomb body during step c).

3. The method according to claim 1, which further comprises placing the molding in contact with the outside of the housing before step b), and removing the molding after step c).

4. The method according to claim 1, which further comprises carrying out the step of contacting outer regions of the housing with the molding during at least one of the following processing steps:

providing brazing material to the honeycomb body;

coating the honeycomb body; and transporting the honeycomb body.

5. A method for producing a honeycomb body having a honeycomb structure disposed in housing, the method comprising the following steps:

a) forming a honeycomb structure;

b) inserting the honeycomb structure into a housing;

c) coating the honeycomb body and forming sintered, brazed and/or welded connections within the honeycomb structure by carrying out a heat treatment operation on the honeycomb structure having the housing;

d) contacting outer regions of the housing with a single molding, at least during steps b) and c); and e) ensuring dimensional accuracy of the honeycomb body by reproducing a desired outer contour of the housing with contact faces of the molding.

6. The method according to claim 1, wherein the housing is closed in a peripheral direction.

7. The method according to claim 1, which further comprises maintaining a desired shape or configuration of the housing with the molding in step e).

* * * * *